United States Patent [19]

Behl

[11] Patent Number: 4,473,884

[45] Date of Patent: Sep. 25, 1984

[54] ELECTRONIC MEDICATION DISPENSING SYSTEM

[75] Inventor: Robert S. Behl, Fairport, N.Y.

[73] Assignee: Sybron Corporation, Rochester, N.Y.

[21] Appl. No.: 337,978

[22] Filed: Jan. 8, 1982

[51] Int. Cl.[3] ..... G08B 5/00; A47B 67/02

[52] U.S. Cl. ..... 364/479; 364/148; 221/2; 221/3

[58] Field of Search ..... 364/413, 479, 402, 148; 206/533, 538, 539; 221/2, 3, 7, 8

[56] References Cited

U.S. PATENT DOCUMENTS

| | | | |
|---|---|---|---|
| 3,556,342 | 1/1971 | Guarr | 221/2 |
| 3,651,984 | 3/1972 | Redenbach | 221/3 |
| 3,722,739 | 3/1973 | Blumberg | 221/3 |
| 3,762,601 | 10/1973 | McLaughlin | 221/2 |
| 3,998,356 | 12/1976 | Christensen | 221/2 |
| 4,223,801 | 9/1980 | Carlson | 221/3 |
| 4,275,384 | 6/1981 | Hicks et al. | 221/2 X |
| 4,360,125 | 11/1982 | Martindale et al. | 364/479 X |
| 4,382,688 | 5/1982 | Machamer | 221/2 X |

*Primary Examiner*—Jerry Smith
*Assistant Examiner*—Allen MacDonald
*Attorney, Agent, or Firm*—Robert A. Gerlach; Joseph C. MacKenzie

[57] ABSTRACT

A portable medication dispensing unit has several compartments for storing pills or other forms of medicine. The dispensing unit is programmed with a medication schedule which causes visual and audio signals when it is time for the medication to be consumed. The medication schedule is optimized to accommodate the user's personal habits and to simplify taking two or more medicines. The programming means may be integral with the dispensing unit or a separate unit.

6 Claims, 8 Drawing Figures

| STEP | ACTION | PROGRAM MODULE |
|---|---|---|
| 1. | ENTER PRESCRIPTION DATA | FRONT PANEL I/O |
| 2. | COMPUTE IDEAL MEDICATION SCHEDULE | INITIAL TIME ASSIGNMENT |
| 3. | CONSOLIDATE MULTIPLE SCHEDULES | OPTIMIZATION/RATIONALIZATION |
| 4. | DISPLAY SCHEDULE FOR VISUAL CHECK | TIME ASSIGNMENT DISPLAY |
| 5. | LOAD SCHEDULE INTO DISPENSING UNIT | TIME ASSIGNMENT LOAD |
| 6. | TEST PERFORMANCE OF LOADED DISPENSING UNIT | DISPENSING UNIT TEST |
| 7. | DISPLAY PROBLEMS IF ANY | FRONT PANEL I/O |
| 8. | PRINT OUT HARD COPY RECORD OF TRANSACTION | PRINTER CONTROL |

FIG. 6

ELECTRONIC MEDICATION DISPENSING SYSTEM

BACKGROUND OF THE INVENTION

This invention pertains to medication cases and is particularly concerned with medication cases having time related indicating means.

Short term and chronic disabilities often require scheduled consumption of medicines, vitamins and the like. The benefits of a low cost high reliability automated medication dispensing system are readily apparent. Various types of alarms and automated dispensing devices have been around for many years, and are the subject of numerous United States patents such as 3,876,296, 4,245,742 and 4,275,384. The medication dispenser which is the subject of the present invention provides advanced features that are not to be found in medication dispensers of the prior art.

SUMMARY OF THE INVENTION

Briefly, there is provided a programmable medication system for storing and dispensing pills or other forms of medication. The system includes a dispensing unit having several compartments, each of which is associated with an indicator. The medication schedule program is first computed and optimized in accordance with both the dosage of the medication and the user's personal eating and sleeping habits. The schedule program is then entered in a memory and subsequently used to activate one of the indicators at a scheduled time. The program may be calculated within the dispenser unit or alternatively by a separate programming unit for entry into the dispenser's memory.

BRIEF DESCRIPTION OF THE DRAWINGS

FIG. 6 shows a software utilization sequence for use by the programmer; and

DESCRIPTION OF THE INVENTION

The invention includes an electronically controlled medication dispenser and a pharmacy programmer used to program the dispenser.

Figure 1:
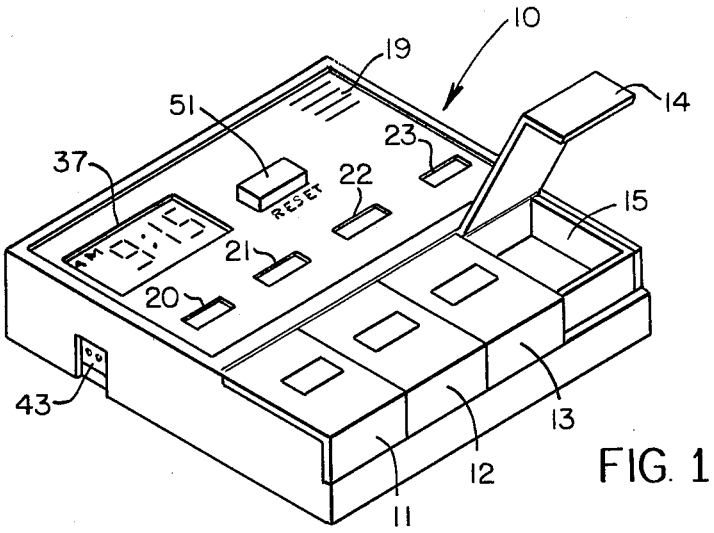
FIG. 1 is a view of a medication dispenser according to the invention.
Figure 2:
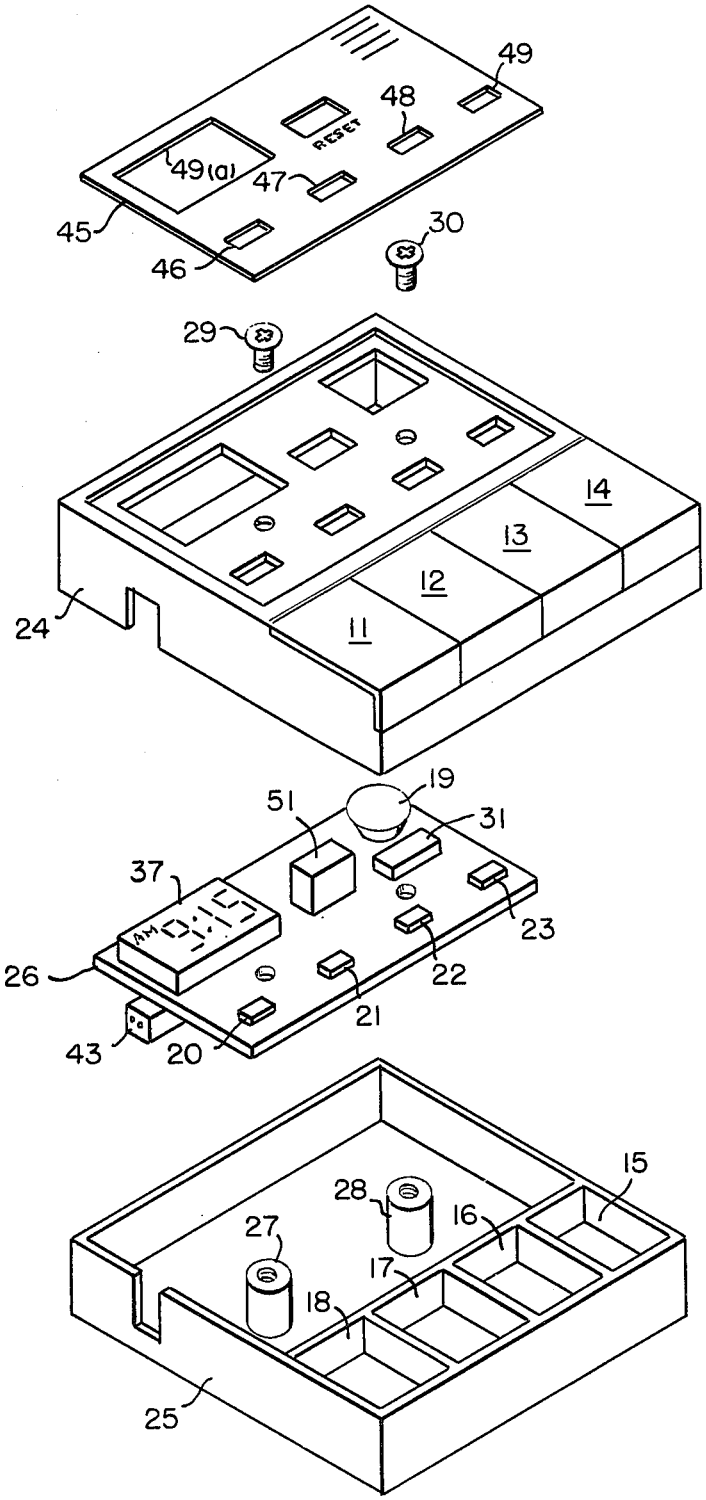
FIG. 2 is an exploded view of the dispenser of FIG. 1.

FIGS. 1 and 2 illustrate an embodiment of a small medication dispenser generally indicated at 10. This dispenser includes a plurality of compartments 15–18 (FIG. 2) for containing the tablets or pills to be dispensed. Each compartment is normally covered by a lid 11–14. In FIG. 1, lid 14 is shown in an open position exposing compartment 15.

The dispenser also includes a digital integrated circuit which at preselected times activates an audible alarm 19 and one of a plurality of small indicators 20–23 further described hereinbelow. In the embodiment shown there are four lids and indicators corresponding to four compartments. More or fewer compartments may be used in keeping with the invention. The medication dispenser 10 as illustrated has a rectangular shape approximately three inches high, four inches wide, and half an inch thick.

Referring to FIG. 2, the major structural components consist of two injection molded halves 24, 25 molded in an impact resistant polymer, such as polypropylene. Upper half 24 includes separately hinged lids 11–13 which may be molded integrally with upper half 24.

A electronic circuit board 26 which carries a microcomputer chip 31, is retained between the two structural halves 24, 25. Board 26 is positioned over studs 27, 28 molded in the bottom half 25 and is clamped in position by the top half 24 held to half 25 by screws 29, 30.

Figure 3:
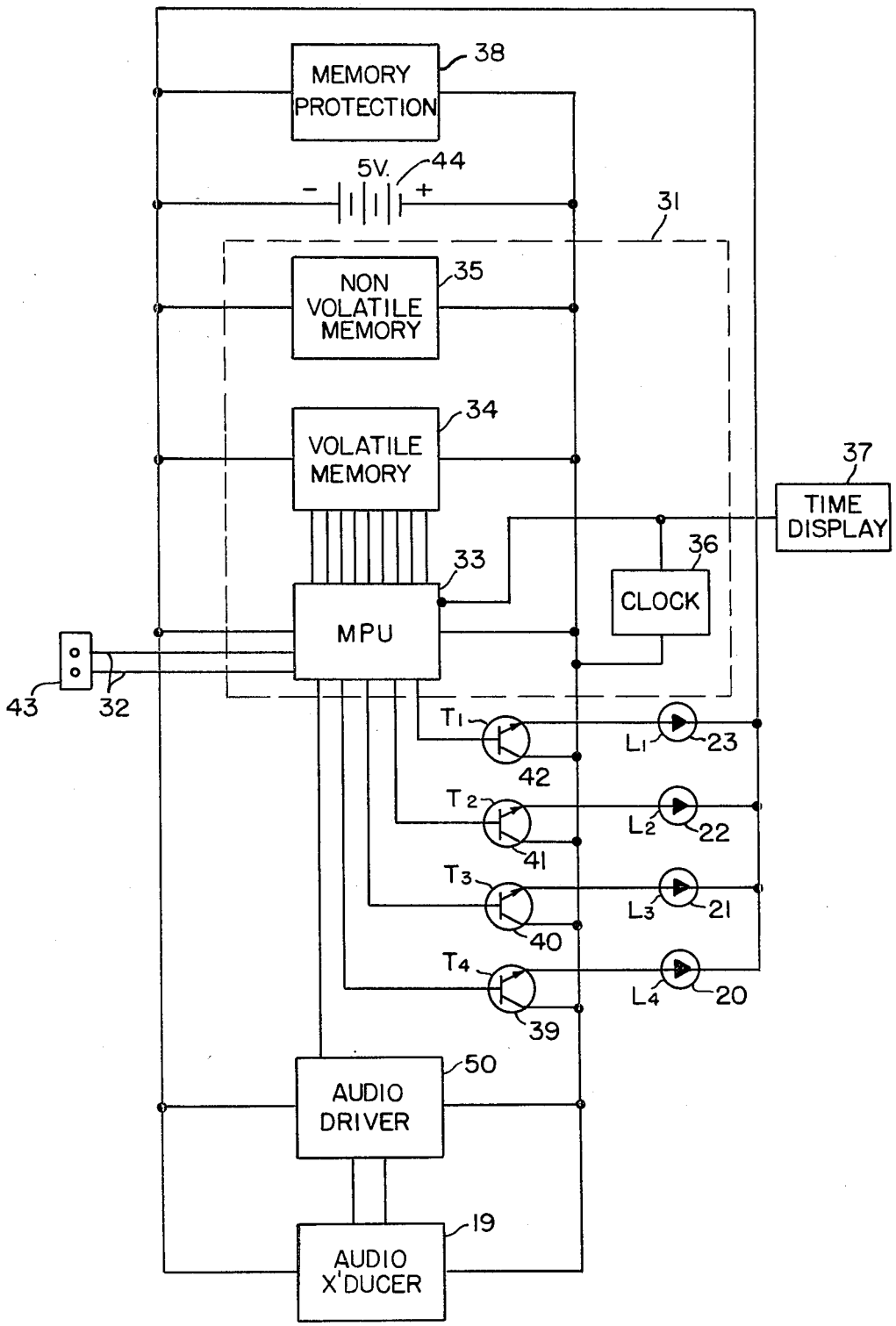
FIG. 3 is a schematic representation of the electronic circuitry within the dispenser.

Chip 31 may be a general purpose microcomputer chip such as a National Semiconductor INS 8048. As best seen in FIG. 3, this microcomputer chip 31 contains multiple input/output ports 32, a microprocessor 33, a volatile memory 34, a non-volatile memory 35, and a clock 36. Clock 36 provides timing information to the microprocessor for an LCD time display 37 and gives information needed to sequence microprocessor activity. Also mounted on board 26 are a memory protection circuit 38 and the indicators 20–23. Each indicator may be a 5-volt light emitting diode and there is one indicator corresponding to each compartment.

Each indicator 20–23 is energized by an associated drive circuit 39–42. When the microcomputer 31 determines that it is time a medication in a particular compartment is to be taken, it enables a drive circuit corresponding to that compartment which in turn energizes its indicator. Simultaneous with the energization of indicators 20–23, the microcomputer chip 31 also activates a driver 50 for energizing the audible alarm 19. This alarm 19 can be a solid state audio transducer such as a Gulton AT 20 HP which is mounted on the circuit board. In this fashion, the patient is given both an audio and a visual signal that a medication must be taken. Moreover, the particular indicator 20–23 which is energized visually identifies which compartment 15–18 contains the medication to be taken.

A female stud mount connector jack 43 is connected to the I/O port 32 of the circuitry and protrudes from the circuit board in such a manner as to make the non-volatile memory 35, or volatile memory 34 protected by a protection circuit 38, accessible to a separate programming unit. This permits the dispensing druggist to individually program the memory 34 or 35 by placing it into a pharmacy programmer, described below. This programmer enters personal data on the patient, and the dosage schedule of the medication.

Completing the structure of dispenser 10 is single 5 volt battery 44 (FIG. 3) for powering the unit and a laminated metal and plastic label 45 (FIG. 2). The battery may be mounted on the circuit board or in a separate battery compartment, while label 45 fits in a recessed portion of the top half 24 and has clear or translucent windows 46–49 and 49*a* through which the indicators 20–23 and time display 37 are visible.

In use, the dispenser 10 is carried in a pocket or purse. At an appropriate time which is determined by the memory and clock circuit of microcomputer 31, the audible signal 19 sounds, softly at first, and then increasing in magnitude. At the same time, the indicator 20–23 above the appropriate compartment flashes. Pushing a reset button 51 silences the alarm 19 and turns off the flashing indicator.

Figure 4:
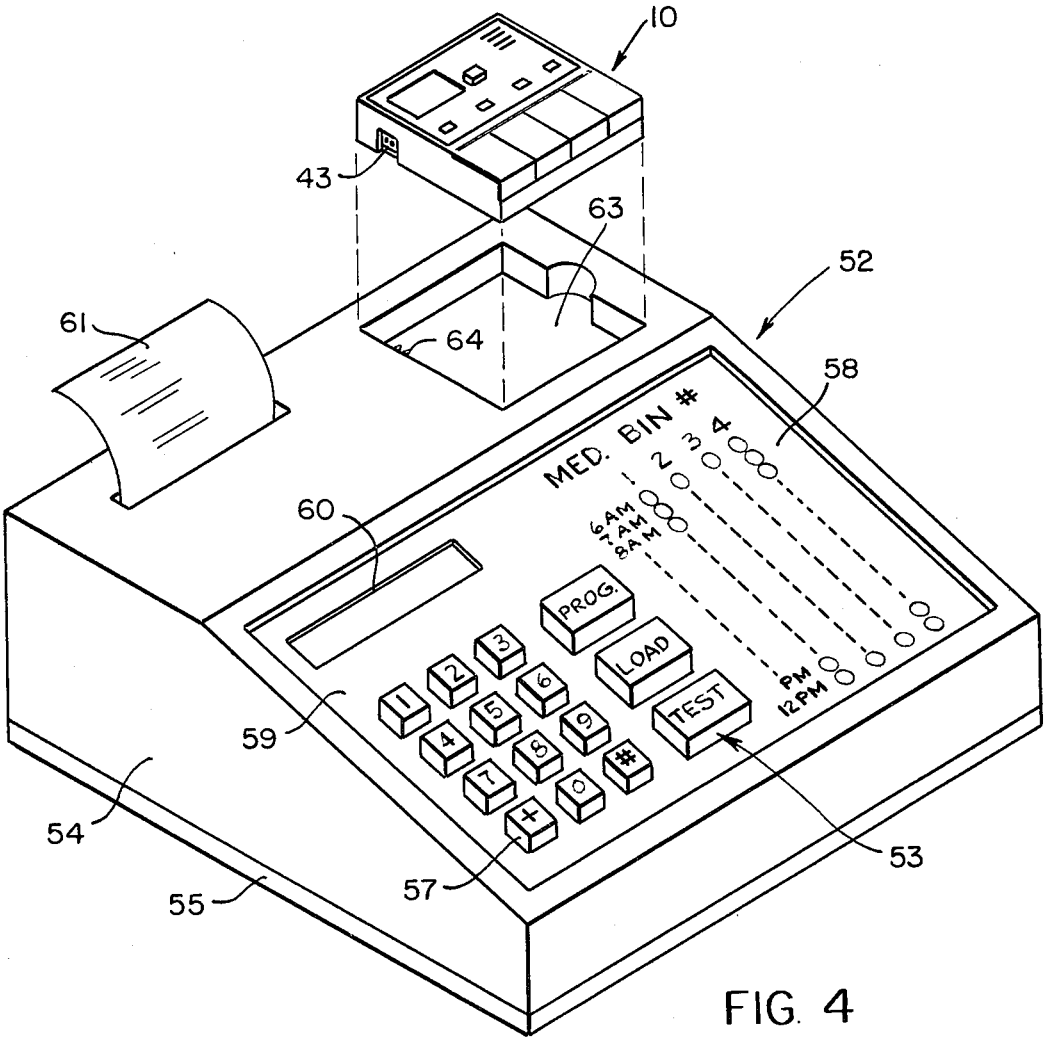
FIG. 4 is a view of a pharmacy programmer according to the invention.
Figure 5:
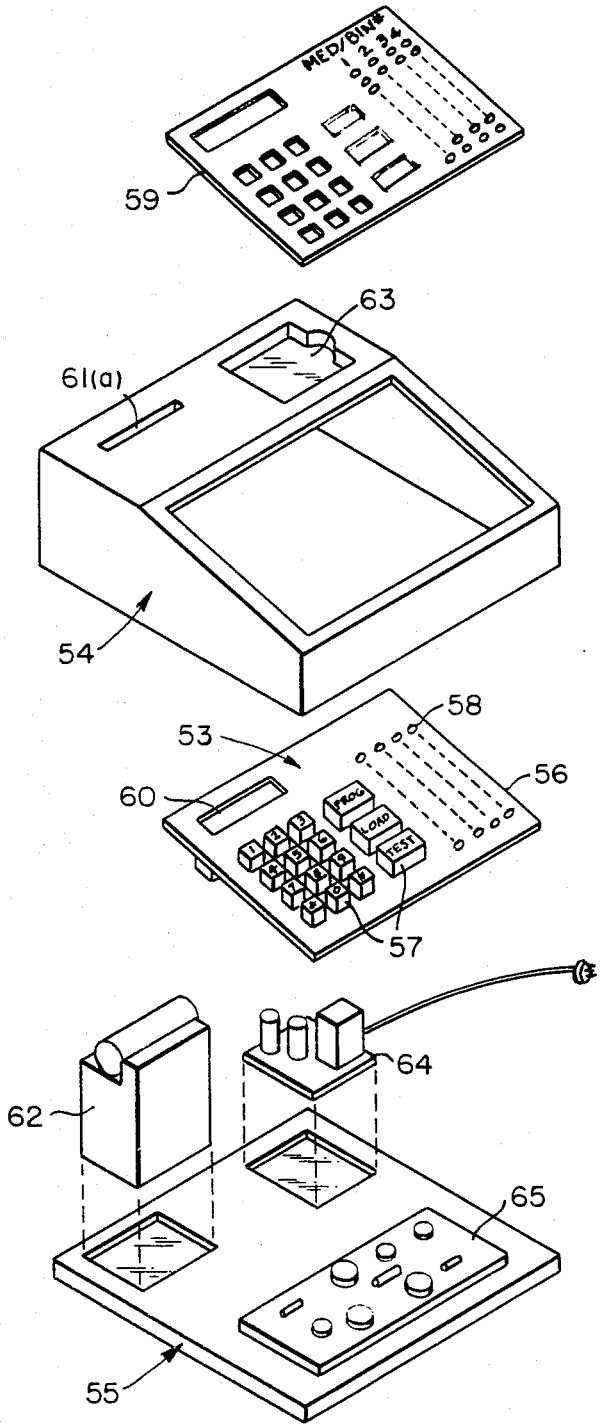
FIG. 5 is an exploded view of the programmer of FIG. 4.

Shown in FIGS. 4 and 5 is a pharmacy programmer unit generally indicated at 52 which can be used to program and test the medication dispenser 10.

The preferred embodiment of the programmer resembles in appearance a desktop calculator and is contained in an enclosure approximately eight inches square by three inches thick. The programmer enclosure consists of a control panel 53 mounted on a molded plastic cover 54, and a base 55 which can be of plastic or metal.

As best shown in FIG. 5, the control panel 53 consists of a circuit board 56 with integral keyboard and control switches 57, an array of display elements 58 and a numeric display 60 for eight or more digits. Directly below switches 57 may be found a standard membrane switch keypad layout (not shown) for data entry. Display elements 58 are preferably LEDs, arranged so as to indicate timing of medication. The vertical columns in the array indicate a particular medication (or compartment in the dispensing module), while the horizontal rows correspond to hours of the day. Appropriate graphics for the array may be provided on an overlay 59 perferably made of clear plastic. The current state of the art in membrane switches and control panel technology could allow the control panel circuit board and the overlay 59 to be constructed in one flat piece.

Control panel 53 is fastened to the face of the programmer cover 54 which is molded from an impact resistant plastic such as ABS. The cover has an opening 61 (a) to accommodate the printout 61 of digital printer 62 (seen in FIG. 5) and a receiver 63 for holding the dispensing unit 10 while programming. In this respect, the dispenser is inserted on the right side of the receiver 63 and, oriented by the close fit, is slid to the left in order to engage its I/O jack 43 with a corresponding male plug 64 of the programmer (FIG. 4).

Digital printer 62 may be a suitable type such as a Texas Instruments Model 1220652-1, and can be is mounted to the base 55. The printer is used to provide a hard copy record of dispensing. Also mounted on base 55 are a main circuit board 65 and a power supply 64.

The main circuit board 65 is similar to that described for the medication dispenser 10 as it contains standard circuit components making up a microcomputer based on a microprocessor chip (such as an INS 8048), which contains a volatile and non-volatile memory, a clock, and multiple input and output ports. Additionally, the board contains various signal conditioning devices to interface with controls and displays on the front panel, a backup power source for maintaining clock function, serial I/O means for communication with the dispenser, and, output means for driving the digital printer 62. Single board computers of this basic configuration are readily available from integrated circuit producers such as INTEL, National Semiconductor, or Texas Instruments in a general purpose form, or may be specifically tailored for this application.

Program storage for the microcomputer is achieved through permanent encoding on either mask programmable or fusable memory devices.

A software utilization chart is given in FIG. 6. The program is split into several general modules including initial time assignment, optimization/rationalization, time assignment display, time assignment load (into the dispenser), dispenser test, print control, and front panel I/O control.

Figure 7A:
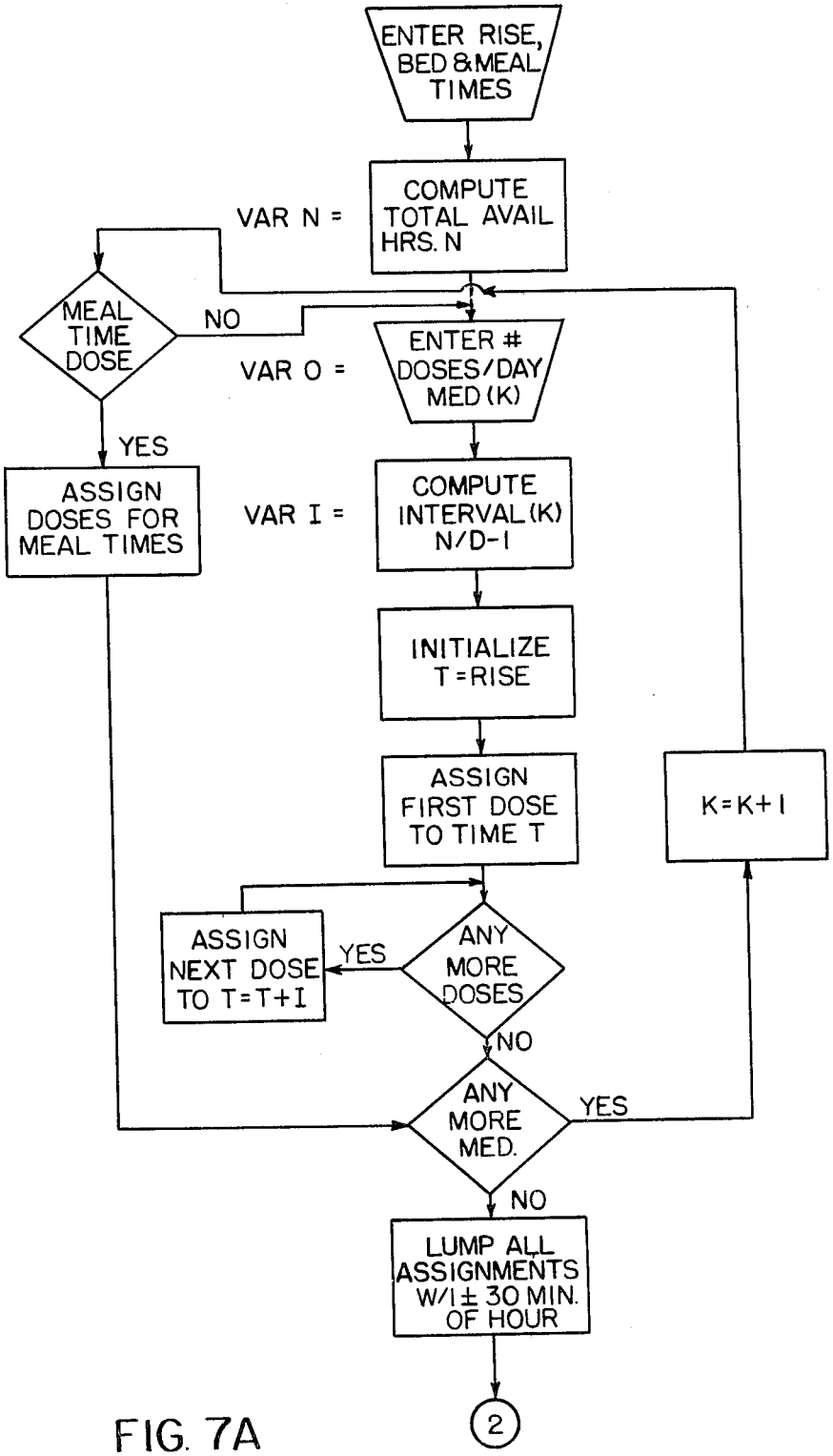
FIG. 7A and B is a flow diagram of a program suitable for use with the programmer.
Figure 7B:
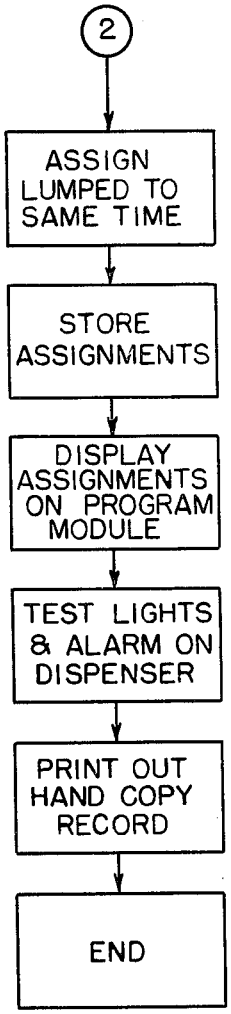

FIG. 7 is a flow chart which illustrates a medication scheduling program. These modules are used in a sequential manner. Data for a particular prescription and personal information such as the patient's rising time, typical meal schedule and hour of retiring is entered through the front panel and loaded into volatile memory of the programmer 52 via the "Front Panel I/O" module. This data is used by an "Initial Time Assignment" module to compute the ideal medication schedule for each drug. An "Optimization/Rationalization" module then merges closely adjacent times on the initial schedule to consolidate and rationalize the ideal schedule into a more easily managed one.

The resulting schedule is displayed for inspection on the front panel LED array 58 through use of the "Time Assignment Display" module. If the schedule is acceptable, the dispenser 10 is placed into the receiver so as to connect its female jack 43 to the plug 64 of the programmer. The schedule, then, can be loaded into the memory of the dispenser, using the "Time Assignment Load" module. Proper operation of the unit is tested using the "Dispensing Unit Test" module. Problems if discovered during the test are displayed on the front panel, again utilizing the "Front Panel I/O" module. Finally, the salient prescription, schedule, and patient data is printed out using the corresponding "Printer Control" module.

This may be done for one, two, three, or even more medications depending upon the size and number of compartments in the dispenser. The schedule remains in the non-volatile or protected memory of the dispenser until it is returned to the pharmacist for a new prescription or refilled with different instructions. At that time, the dispenser is again inserted into the programmer which changes the contents of the dispenser's memory.

Alternatively, the dispenser module may be configured to calculate its own medication schedule by using simplified circuits and I/O ports. The pharmacist could, for example, enter pertinent data by means of small rocker switches located in the battery compartment or elsewhere on the unit.

It will be appreciated that the invention provides for a portable medication dispensing unit which may be programmed with an optimized medication schedule. Programming may be implemented by a programing unit and the schedule may be modified before use by the dispensing pharmacist.

Having described my invention, I claim:

1. A programmable medication dispenser system comprising:

(a) a dispenser having a plurality of compartments for containing doses of medicine;

(b) indicating means on said dispenser corresponding to said compartments;

(c) a programmer means associated with said dispenser for utilizing input data pertaining to a patient's medication prescription and personal habits to develop a program corresponding to a timed medication schedule for the patient;

(d) a programmable electronic memory in said dispenser for storing said program;

(e) means for entering said program into said memory directly from said programmer means; and (f) means in said dispenser acting responsive to the program in said memory for activating said indicating means when the time of day coincides with the time of said medication schedule.

2. A medication dispensing system, including, in combination;

(a) a programmer having manually operable means for converting medical information into programming signals;

(b) a first port forming part of said programmer and outputting said programming signals;

(c) a dispenser for dispensing medication in accordance with a predetermined schedule corresponding to the personal requirements of a particular patient;

(d) a second port on said dispenser, said second port being attachable and detachable from said first port, for receiving said programming signals while attached to said first port;

(e) a control means in said dispenser for producing control effects in accordance with said predetermined schedule, said control means being programmable by said programming signals while said second port is connected to said first port wherein said programming signals as received by said second port from said first port are presented directly to said control means; and (f) said control means operating in response to having been programmed by said programming signals to produce said control effects in accordance with said predetermined schedule, during a period of time following detachment of said second port from first port, and while said second port is detached from said first port.

3. The system of claim 2, wherein said control means includes memory means retaining, after said second port is detached from said first port, a memory of a program corresponding to said programmable signals, and said control means is responsive to said memory to produce said control effects in accordance with a schedule corresponding to said memory.

4. A medication dispenser comprising:

(a) port means readily attachable and detachable to a programmer for receiving a medication program produced by said programmer from information relating to a particular patient; and (b) said dispenser having storage means connected to said port means for storing said program, and said dispenser also including control means connected to said storage means and operating in accordance with said program such as to produce control effects in accordance with a schedule of the personal requirements of said patient;

the operation of said control means in accordance with said program occurring after said port means has been attached to said programmer, and continuing over a period of time in which said port means remains detached from said programmer.

5. A medication dispensing system, including, in combination;

(a) a programmer having manually operable means for converting medical information into programming signals;

(b) a first port forming part of said programmer and outputting said programming signals;

(c) a dispenser for dispensing medication in accordance with a predetermined schedule corresponding to the personal requirements of a particular patient;

(d) a second port on said dispenser, said second port being attachable and detachable from said first port, for receiving said programming signals while attached to said first port;

(e) control means in said dispenser for producing control effects in accordance with said predetermined schedule, said control means being programmable by said programming signals while said second port is connected to said first port wherein said programming signals as received by said second port from said first port are presented directly to said control means; and (f) said control means operating in response to having been programmed by said programming signals to produce said control effects in accordance with said predetermined schedule, during a period of time following detachment of said second port from said first port, and while said second port is detached from said first port; and (g) said programmer being a computer means operable in response to medical information to cause said programming signals to correspond to an optimized medication schedule.

6. A medication dispensing system, including, in combination;

(a) a programmer having manually operable means for converting medical information into programming signals;

(b) a first port forming part of said programmer and outputting said programming signals;

(c) a dispenser for dispensing medication in accordance with a predetermined schedule corresponding to the personal requirements of a particular patient;

(d) a second port on said dispenser, said second port being attachable and detachable from said first port, for receiving said programming signals while attached to said first port;

(e) control means in said dispenser for producing control effects in accordance with said predetermined schedule, said control means being programmable by said programming signals while said second port is connected to said first port wherein said programming signals as received by said second port from said first port are presented directly to said control means;

(f) said control means operating in response to having been programmed by said programming signals to produce said control effects in accordance with said predetermined schedule, during a period of time following detachment of said second port from said first port, and while said second port is detached from said first port;

(g) said control means including memory means retaining, after said second port is detached from said first port, a memory of a program corresponding to said programmable signal, said control means being responsive to said memory means to produce said control effects in accordance with a schedule corresponding to said memory; and (h) said programmer being a computer means operable in response to medical information to cause said programming signals to correspond to an optimized medication schedule.

* * * * *